US006254799B1

(12) United States Patent
Antika et al.

(10) Patent No.: US 6,254,799 B1
(45) Date of Patent: Jul. 3, 2001

(54) PHOSPHATE ESTER BASE STOCKS COMPRISING MIXED N-BUTYL/ISOBUTYL PHOSPHATE ESTERS AND AIRCRAFT HYDRAULIC FLUIDS COMPRISING THE SAME

(75) Inventors: Shlomo Antika, Maplewood, NJ (US); Marc-André Poirer, Sarnia (CA)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/433,943

(22) Filed: Nov. 4, 1999

Related U.S. Application Data

(60) Provisional application No. 60/107,923, filed on Nov. 10, 1998.

(51) Int. Cl.[7] ..... G09K 5/00

(52) U.S. Cl. ..... 252/78.5; 71/75; 508/440

(58) Field of Search ..... 252/78.5, 75.71; 508/440

(56) References Cited

U.S. PATENT DOCUMENTS

| | | | |
|---|---|---|---|
| 3,679,587 | 7/1972 | Smith | 252/75 |
| 3,718,596 | 2/1973 | Richard, Jr. | 252/78 |
| 3,723,320 | 3/1973 | Herber et al. | 252/78 |
| 4,206,067 | 6/1980 | MacKinnon | 252/75 |
| 4,302,346 | 11/1981 | MacKinnon | 252/75 |
| 4,324,674 | 4/1982 | MacKinnon | 252/78.5 |
| 5,035,824 | 7/1991 | MacKinnon | 252/75 |
| 5,205,951 | 4/1993 | MacKinnon | 252/78.5 |
| 5,318,710 | 6/1994 | Campbell | 252/25 |
| 5,464,551 | 11/1995 | Deetman . | |
| 5,817,606 | 10/1998 | Kinker et al. | 508/440 |

FOREIGN PATENT DOCUMENTS

| | | |
|---|---|---|
| 0 823 472 A1 | 11/1998 | (EP) . |
| WO 96/17517 | 6/1996 | (WO) . |

*Primary Examiner*—Yogendra Gupta
*Assistant Examiner*—Derrick G. Hamlin
(74) *Attorney, Agent, or Firm*—Joseph J. Allocca

(57) ABSTRACT

Disclosed are phosphate ester base fluids and aircraft hydraulic fluids containing mixed n-butyl/isobutyl phosphate ester components. The disclosed aircraft hydraulic fluids contain from about 30 to about 95 weight percent, based on the total weight of the fluid, of n-butyl diisobutyl phosphate or di-n-butyl isobutyl phosphate or a mixture thereof; from 0 to about 15 weight percent, based on the total weight of the fluid, of one or more triaryl phosphates; and an effective amount of a viscosity index improver, an acid control additive and an erosion inhibitor.

13 Claims, 1 Drawing Sheet

PHOSPHATE ESTER BASE STOCKS COMPRISING MIXED N-BUTYL/ISOBUTYL PHOSPHATE ESTERS AND AIRCRAFT HYDRAULIC FLUIDS COMPRISING THE SAME

CROSS-REFERENCE TO RELATED APPLICATIONS

This application claims the benefit of U.S. Ser. No. 60/107,923, filed Nov. 10, 1998, the disclosure of which is incorporated herein by reference in its entirety.

BACKGROUND OF THE INVENTION

1. Field of the Invention

This invention relates to phosphate ester base stock compositions comprising mixed n-butyl/isobutyl phosphate esters and to aircraft hydraulic fluid compositions comprising such base stocks.

2. State of the Art

Hydraulic fluids used in the hydraulic systems of aircraft must meet exacting specifications set by aircraft manufacturers. Accordingly, the components of aircraft hydraulic fluids are carefully chosen to balance, among other properties, stability, compatibility, density, toxicity and the like. Whether the selected components can, in fact, be balanced to meet these specifications is unpredictable. Moreover, the amounts of individual components used in compositions which meet the specifications is not a priori predictable.

Trialkyl phosphate esters, such as tri-n-butyl phosphate and triisobutyl phosphate, have been used previously as base stocks for aviation hydraulic fluids. For example, trialkyl phosphate ester base stocks are described in U.S. Pat. No. 5,464,551, the disclosure of which is incorporated herein by reference in its entirety. In particular, low density aviation hydraulic fluids, i.e., fluids having a density below about 1.020 g/L at 25° C., have conventionally been prepared using tri-n-butyl phosphate as the major component of the base stock. However, tri-n-butyl phosphate is known to be a skin irritant and minimizing its concentration is desirable. Alternatively, low density fluids employing triisobutyl phosphate as the major component have had difficulty meeting the low volatility and low temperature viscosity requirements imposed on aviation hydraulic fluids.

It has now been discovered that phosphate ester base stocks comprising mixed isobutyl/n-butyl phosphate esters, i.e., n-butyl diisobutyl phosphate or di-n-butyl isobutyl phosphate or mixtures thereof, have surprising and unexpected properties when compared to base stocks containing major amounts of tri-n-butyl phosphate and triisobutyl phosphate or physical mixtures thereof. Specifically, it has been found that by employing mixed isobutyl/n-butyl phosphate esters in the base stock of the fluid, an unexpected, surprising balance of properties critical to aviation hydraulic fluids is obtained, including acceptable hydrolytic stability, high flash point, good anti-wear properties, acceptable erosion protection, acceptable low temperature flow properties (viscosity), and elastomer compatibility.

SUMMARY OF THE INVENTION

This invention is directed to phosphate ester base stock compositions comprising n-butyl diisobutyl phosphate or di-n-butyl isobutyl phosphate or a mixture thereof, and to aircraft hydraulic fluid compositions containing such base stock compositions.

Accordingly, in one of its composition aspects, the present invention is directed to an aircraft hydraulic fluid composition comprising:

(a) from about 30 to about 95 weight percent, based on the total weight of the fluid, of a phosphate ester selected from the group consisting of n-butyl diisobutyl phosphate, di-n-butyl isobutyl phosphate and mixtures thereof;

(b) from 0 to about 15 weight percent, based on the total weight of the fluid, of one or more triaryl phosphates;

(c) an effective amount of a viscosity index improver;

(d) an effective amount of acid control additive; and (e) an effective amount of an erosion inhibitor.

Preferably, the aircraft hydraulic fluid comprises from about 30 to about 90 weight percent of a phosphate ester selected from the group consisting of n-butyl diisobutyl phosphate, di-n-butyl isobutyl phosphate and mixtures thereof, based on the total weight of the fluid.

In a preferred embodiment, the aircraft hydraulic fluids of this invention further comprise:

(f) an effective amount of a rust inhibitor or a mixture of rust inhibitors; and (g) an effective amount of an antioxidant or a mixture of antioxidants.

In a preferred embodiment, the present invention is directed to an aircraft hydraulic fluid composition comprising about 30 to about 95 weight percent, based on the total weight of the fluid, of a phosphate ester base stock comprising a phosphate ester selected from the group consisting of n-butyl diisobutyl phosphate, di-n-butyl isobutyl phosphate and mixtures thereof, and a sufficient amount of one or more triaryl phosphates such that the base stock composition produces no more than 25% elastomer seal swell; an effective amount of a viscosity index improver; an effective amount of acid control additive; and an effective amount of an erosion inhibitor.

In another preferred embodiment, the present invention is directed to an aircraft hydraulic fluid composition comprising about 30 to about 95 weight percent, based on the total weight of the fluid, of a phosphate ester base stock comprising from about 4 to about 14 weight percent, based on the total weight of the fluid, of one or more triaryl phosphates, the remainder of the base stock comprising a phosphate ester selected from the group consisting of n-butyl diisobutyl phosphate, di-n-butyl isobutyl phosphate and mixtures thereof; an effective amount of a viscosity index improver; an effective amount of acid control additive; and an effective amount of an erosion inhibitor.

In yet another preferred embodiment, the present invention is directed to an aircraft hydraulic fluid comprising:

(a) from about 30 to about 95 weight percent, based on the total weight of the fluid, of a phosphate ester selected from the group consisting of n-butyl diisobutyl phosphate, di-n-butyl isobutyl phosphate and mixtures thereof;

(b) from about 0 to about 15 weight percent, based on the total weight of the fluid, of one or more triaryl phosphates;

(c) from about 4 to 6 weight percent, based on the total weight of the fluid, of a viscosity index improver;

(d) from about 5 to 6.5 weight percent, based on the total weight of the fluid, of an acid control additive;

(e) from about 0.05 to about 0.1 weight percent, based on the total weight of the fluid, of an erosion inhibitor;

(f) from about 0.005 to about 0.5 weight percent, based on the total weight of the fluid, of a rust inhibitor or a mixture of rust inhibitors; and (g) from about 0.5 to about 2.5 weight percent, based on the total weight of the fluid, of an antioxidant or a mixture of antioxidants.

In one embodiment of the present invention, the aircraft hydraulic fluid further comprises from about 1 to about 30 weight percent of triisobutyl phosphate based on the total weight of the fluid.

In another embodiment, the aircraft hydraulic fluid comprises less than 15 weight percent, preferably less than 5 weight percent, of tri-n-butyl phosphate based on the total weight of the fluid.

In another of its composition aspects, this invention is directed to a phosphate ester base stock for use in aircraft hydraulic fluids comprising:

(a) from about 50 to 100 weight percent, based on the total weight of the base stock, of a phosphate ester selected from the group consisting of n-butyl diisobutyl phosphate, di-n-butyl isobutyl phosphate and mixtures thereof;

(b) from 0 to about 15 weight percent, based on the total weight of the base stock, of one or more triaryl phosphates.

Preferably, the phosphate ester base stock comprises from 60 to 100 weight percent, more preferably from 80 to 100 weight percent, and still more preferably from 85 to 100 weight percent, based on the total weight of the base stock, of a phosphate ester selected from the group consisting of n-butyl diisobutyl phosphate, di-n-butyl isobutyl phosphate and mixtures thereof;

In a preferred embodiment, this invention is directed to a phosphate ester base stock for use in aircraft hydraulic fluids comprising a phosphate ester selected from the group consisting of n-butyl diisobutyl phosphate, di-n-butyl isobutyl phosphate and mixtures thereof, and a sufficient amount of one or more triaryl phosphates such that the base stock composition produces no more than 25% elastomer seal swell.

In another of its composition aspects, this invention is directed to a phosphate ester base stock for use in aircraft hydraulic fluids comprising from about 5 to about 15 weight percent, based on the total weight of the base stock, of one or more triaryl phosphates, the remainder of the base stock comprising a phosphate ester selected from the group consisting of n-butyl diisobutyl phosphate, di-n-butyl isobutyl phosphate and mixtures thereof.

DETAILED DESCRIPTION OF THE INVENTION

Figure 1:
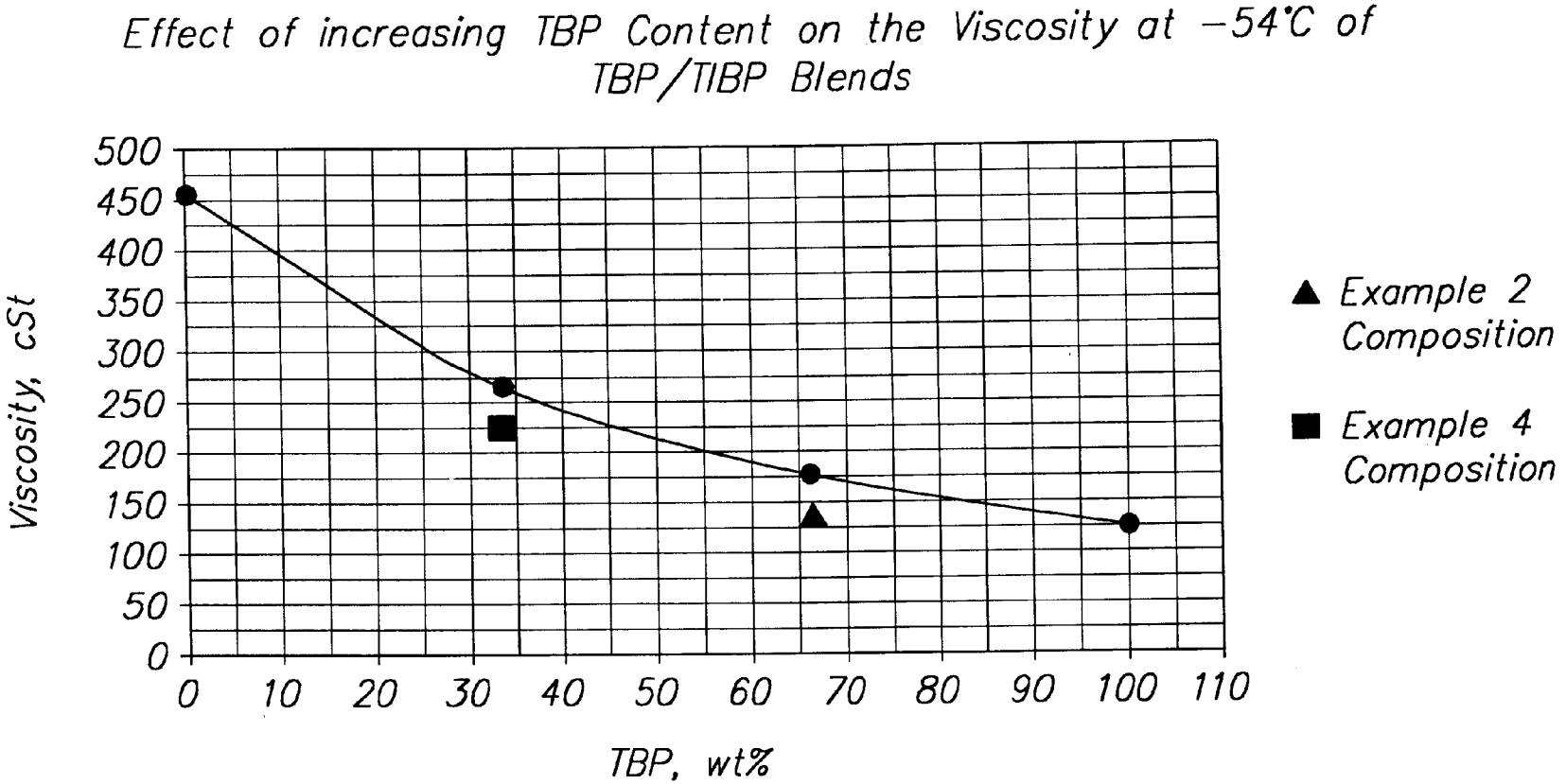
FIG. 1 is a graph illustrating the effect of tri-n-butyl phosphate (TBP) content on the viscosity at −54° C. of tri-n-butyl phosphate/triisobutyl phosphate blends. The viscosity at −54° C. of the product of Example 2, i.e., essentially di-n-butyl isobutyl phosphate, and the product of Example 4, essentially n-butyl diisobutyl phosphate, are also illustrated.

This invention is directed to novel phosphate ester base stock compositions and to aircraft hydraulic fluid compositions containing such base stocks. The compositions described herein are conventionally prepared by blending the components of the composition together until homogeneous. The blending process may be conducted as a single step process where all of the components are combined and then blended or may be conducted as a multi-step process where two or more of the components are combined and blended and additional components are added to the blended mixture and the resulting mixture further blended.

Preferably, the erosion inhibitor (and optionally the antioxidants that are normally solids) is preblended with at least one of the phosphate ester base stock components to ensure complete dissolution of the erosion inhibitor before addition to the preblend of the remaining additives and phosphate ester component(s).

The phrase "the base stock composition produces no more than 25% elastomer seal swell" means that under industry standard testing conditions, such as Aerospace Industry Association NAS-1613 or Boeing D6-3614, where an approved elastomer is immersed in the aircraft hydraulic fluid and exposed to severe aging conditions such as 334 hours at 225° F. (107.2° C.), elastomer seal swell does not exceed 25%. Preferably elastomer seal swell does not exceed 20%.

The term "alkyl" as used herein refers to a monovalent branched or unbranched saturated hydrocarbon group preferably having from 1 to about 12 carbon atoms, more preferably 1 to 8 carbon atoms and still more preferably 1 to 6 carbon atoms. This term is exemplified by groups such as methyl, ethyl, n-propyl, isopropyl, n-butyl, isobutyl, tert-butyl, n-hexyl, n-octyl, tert-octyl, triisopropyl (C9), tetraisopropyl (C12), and the like.

"Cycloalkyl" refers to cyclic alkyl groups of from 3 to 10 carbon atoms having a single cyclic ring or multiple condensed rings which can be optionally substituted with from 1 to 3 alkyl groups. Such cycloalkyl groups include, by way of example, cyclopropyl, cyclobutyl, cyclopentyl, cyclohexyl, cyclooctyl, 1-methylcyclopropyl, 2-methylcyclopentyl, 2-methylcyclooctyl.

"Aryl" refers to an unsaturated aromatic carbocyclic group of from 6 to 14 carbon atoms having a single ring (e.g., phenyl) or multiple condensed rings (e.g., naphthyl). Such aryl groups may be unsubstituted, such as phenyl, naphthyl and the like, or may be substituted with, for example, one or more alkyl groups and preferably 1–2 alkyl groups, such as methyl, ethyl, n-propyl, isopropyl, n-butyl, isobutyl, tert-butyl or mixtures thereof. Representative alkyl-substituted aryl groups include, by way of illustration, 4-isopropylphenyl, 4-tert-butylphenyl, triisopropylated aryl, tetraisopropylated aryl, and the like. Examples of suitable triaryl phosphates include, but are not limited to, triphenyl phosphate, tricresyl phosphate, tri-(isopropylphenyl) phosphate, tri-(tert-butylphenyl) phosphate and the like.

The phosphate ester base stock composition of this invention comprises n-butyl diisobutyl phosphate or di-n-butyl isobutyl phosphate or a mixture of n-butyl diisobutyl phosphate and di-n-butyl isobutyl phosphate. n-Butyl diisobutyl phosphate (BDIBP) and di-n-butyl isobutyl phosphate (DBIBP) have formulas I and II, respectively:

I

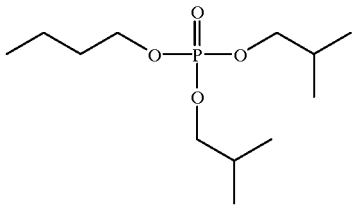

-continued

II

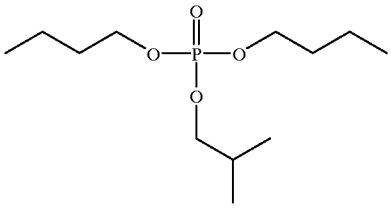

In one embodiment, a mixture of I and II are employed in the base stock and preferably this mixture employs from about 1 to about 99% by weight I and from about 99 to 1% by weight II.

The phosphate ester base stock composition may also contain minor amounts, preferably 30 weight % or less, more preferably 25 weight % or less, of other trialkyl phosphate esters, such as triisobutyl phosphate. Preferably, the phosphate ester base stock composition contains less than 15 weight %, more preferably less than 10 weight %, still more preferably less than 5 weight %, and yet more preferably less than 2 weight %, of tri-n-butyl phosphate.

In a preferred embodiment, the phosphate ester base fluid of this invention further comprises a sufficient amount of one or more triaryl phosphates such that the base stock composition produces no more than 25% elastomer seal swell.

Preferably, the phosphate ester base stock composition of this invention comprises from about 5 to about 15 weight percent, based on the total weight of the base stock, of one or more triaryl phosphates, the remainder comprising a phosphate ester selected from the group consisting of n-butyl diisobutyl phosphate, di-n-butyl isobutyl phosphate and mixtures thereof. In a preferred embodiment, the phosphate ester base stock composition comprises 5 to 15 weight percent of tri-(isopropylphenyl) phosphate, the remainder comprising a phosphate ester selected from the group consisting of n-butyl diisobutyl phosphate, di-n-butyl isobutyl phosphate and mixtures thereof.

The phosphate ester base stock compositions of this invention may be combined with one or more additives to provide novel aircraft hydraulic fluid compositions. The additive package employed in the phosphate ester base stock will typically comprises about 5 to about 15 weight percent of the aviation hydraulic fluid.

The n-butyl diisobutyl phosphate and di-n-butyl isobutyl phosphate (or mixtures thereof) employed in this invention can be prepared using well-known procedures and reagents. For example, as discussed in Gunderson and Hart, *Synthetic Lubricants* (Reinhold Publishing, 1962) at page 106, such mixed phosphate esters are typically prepared by reacting phosphorous oxychloride with a mixture of the corresponding alcohols or the alkali metal alkoxides. For example, n-butyl diisobutyl phosphate and di-n-butyl isobutyl phosphate can be prepared by reacting phosphorus oxychloride with the appropriate ratio of n-butanol and isobutanol or with, for example, sodium n-butoxide and sodium isobutoxide. It may be necessary to separate any undesired tri-n-butyl phosphate or triisobutyl phosphate for the desired mixed ester(s) by, for example, fractional distillation. This reaction may also be conducted sequentially. For example, by first reacting one mole equivalent of phosphorous oxychloride with one mole equivalent of n-butanol or sodium n-butoxide and then reacting the intermediate product with two mole equivalents of isobutanol or sodium isobutoxide, a mixture containing predominately n-butyl diisobutyl phosphate is prepared. Similarly, a mixture containing predominately di-n-butyl isobutyl phosphate is prepared by first reacting one mole equivalent of phosphorous oxychloride with one mole equivalent of isobutanol or sodium isobutoxide and then reacting the intermediate product with two mole equivalents of n-butanol or sodium n-butoxide. After fractional distillation to remove any undesired by-products, the n-butyl diisobutyl phosphate and di-n-butyl isobutyl phosphate prepared by these methods may be further mixed to achieve the desired ratio of mixed phosphate ester components.

Alternatively, di-n-butyl isobutyl phosphate can be prepared by first reacting phosphorous trichloride with about 3 mole equivalents of dry n-butanol in an inert diluent, such as benzene, to afford tri-n-butyl phosphite. This reaction is typically conducted at a temperature of about 0° C. for about 1 to about 6 hours. The resulting tri-n-butyl phosphite is typically not isolated, but is immediately reacted with one mole equivalent (based on the phosphorous trichloride) of sulfuryl chloride at a temperature of about 0° C. for about 1 to about 6 hours to afford di-n-butyl chlorophosphate. The di-n-butyl chlorophosphate is then reacted with one mole equivalent of isobutanol in the presence of excess pyridine in an inert diluent, such as benzene, to afford di-n-butyl isobutyl phosphate. This reaction is typically conducted initially at a temperature of about 0° C. and then allowed to stir at ambient temperature for about 24 to about 48 hours. If desired, the resulting di-n-butyl isobutyl phosphate can be purified by distillation (68° C. at 0.02 torr). By employing isobutanol followed by n-butanol in this procedure, n-butyl diisobutyl phosphate can also be prepared.

The triaryl phosphate(s) employed in this invention may be any triaryl phosphate suitable for use in aircraft hydraulic fluids including, by way of example, tri(unsubstituted aryl) phosphates, such as triphenyl phosphate; tri(substitutued aryl) phosphates, such as tri(alkylated)phenyl phosphates; and triaryl phosphates having a mixture of substituted and unsubstituted aryl groups. Preferably, the triaryl phosphate is a tri(alkylated) aryl phosphate, such as triphenyl phosphate, tri(isopropylphenyl) phosphate, tri(tert-butylphenyl) phosphate, tricresyl phosphate and the like. Mixtures of triaryl phosphate can be used in this invention. The triaryl phosphate esters employed in this invention are commercially available from FMC and Akzo/Nobel.

A viscosity index (VI) improver is typically employed in the hydraulic fluid compositions of this invention in an amount effective to reduce the effect of temperature on the viscosity of the aircraft hydraulic fluid. Examples of suitable VI improvers are disclosed, for example, in U.S. Pat. No. 5,464,551 and U.S. Pat. No. 3,718,596, the entire disclosures of which are incorporated herein by reference in their entirety. Preferred VI improvers include poly(alkyl acrylate) and poly(alkyl methacrylate) esters of the type disclosed in U.S. Pat. No. 3,718,596, and which are commercially available from Rohm & Haas, Philadelphia, Pa. and others. Such esters typically have a weight average molecular weight range of from about 50,000 to about 1,500,000 and preferably from about 50,000 to 250,000. Preferred VI improvers include those having a molecular weight peak at about 70,000 to 100,000 (e.g., about 85,000 or 90,000 to 100,000). Mixtures of VI improvers can also be used.

The VI improver is employed in an amount effective to reduce the effect of temperature on viscosity, preferably from about 2 to about 10 weight percent (on an active ingredient basis) and more preferably from about 4 to about 8 weight percent, and still more preferably from about 4 to about 6 weight percent based on the total weight of the hydraulic fluid composition. In one embodiment, the VI improver is formulated in a phosphate ester solvent, typically as a 1:1 mixture. Phosphate esters suitable for use as a solvent include, by way of example, n-butyl diisobutyl phosphate, di-n-butyl isobutyl phosphate, tri-n-butyl phosphate, triisobutyl phosphate and mixture thereof.

Typically, the aircraft hydraulic fluid compositions of this invention further comprise an acid control additive or acid scavenger in an amount effective to neutralize acids formed in aircraft hydraulic fluid, such as the partial esters of phosphoric acid derived from hydrolysis of the phosphate ester base stock. Suitable acid control additives are described, for example, in U.S. Pat. No. 5,464,551; U.S. Pat. No. 3,723,320 and U.S. Pat. No. 4,206,067, the disclosures of which are incorporated herein in their entirety.

Preferred acid control additives have the formula:

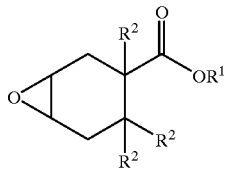

wherein $R^1$ is selected from the group consisting of alkyl of from 1 to 10 carbon atoms, substituted alkyl of from 1 to 10 carbon atoms and from 1 to 4 ether oxygen atoms and cycloalkyl of from 3 to 10 carbon atoms; each $R^2$ is independently selected from the group consisting of hydrogen, alkyl of from 1 to 10 carbon atoms and —C(O)$OR^3$ where $R^3$ is selected from the group consisting of alkyl of from 1 to 10 carbon atoms, substituted alkyl of from 1 to 10 carbon atoms and from 1 to 4 ether oxygen atoms and cycloalkyl of from 3 to 10 carbon atoms.

Particularly preferred acid control additives of the above formula are the monoepoxide, 7-oxabicyclo[4.1.0]heptane-3-carboxylic acid, 2-ethylhexyl ester which is disclosed in U.S. Pat. No. 3,723,320, and the monoepoxide 7-oxabicyclo[4.1.0]-heptane-3,4-dicarboxylic acid, dialkyl esters (e.g., the diisobutyl ester).

The acid control additive is employed in an amount effective to scavenge the acid generated, typically as partial esters of phosphoric acid, during operation of the power transmission mechanisms of an aircraft. Preferably, the acid control additive is employed in an amount ranging from about 4 to about 10 weight percent, based on the total weight of the hydraulic fluid composition, and more preferably from 4 to 8 weight percent and still more preferably from 5 to 7 weight percent.

The hydraulic fluid compositions of this invention also typically comprise an erosion inhibitor in an amount effective to inhibit flow-induced electrochemical corrosion of, for example, a servo-valve. Suitable erosion inhibitors are disclosed, for example, in U.S. Pat. No. 3,679,587, the entire disclosure of which is incorporated herein by reference in its entirety. Preferred erosion inhibitors include the alkali metal salts, and preferably the potassium salt, of a perfluoroalkyl or perfluorocycloalkyl sulfonate as disclosed in U.S. Pat. No. 3,679,587. Such perfluoroalkyl and perfluorocycloalkyl sulfonates preferably encompass alkyl groups of from 1 to 10 carbon atoms and cycloalkyl groups of from 3 to 10 carbon atoms. Examples of suitable erosion inhibitors include perfluorooctyl sulfonic acid potassium salt and perfluorocyclohexyl sulfonic acid potassium salt or mixtures thereof. Several of these perfluoroalkyl sulfonates are available commercially under the tradenames FC-95, FC-98, and the like, from, for example, 3M, Minneapolis, Minn.

The erosion inhibitor is employed in an amount effective to inhibit erosion in the power transmission mechanisms of an aircraft and, preferably, is employed in an amount of from about 0.01 to about 0.15 weight percent, based on the total weight of the hydraulic fluid composition and more preferably from about 0.2 to about 0.1 weight percent, and still more preferably from about 0.05 to about 0.1 weight percent. Mixtures of such anti-erosion agents can be used.

In a preferred embodiment, the hydraulic fluid compositions of this invention further comprise an antioxidant or mixture of antioxidants in an amount effective to inhibit oxidation of the hydraulic fluid or any of its components. Suitable antioxidants are described, for example, in U.S. Pat. No. 5,464,551, the entire disclosure of which is incorporated herein by reference in its entirety, and other aircraft hydraulic fluid patents and publications.

Representative antioxidants include, by way of example, hindered phenolic antioxidants, such as 2,6-di-tert-butyl-p-cresol, tetrakis[methylene(3,5-di-tert-butyl-4-hydroxyhydrocinnamate)]methane (commercially available from Ciba Geigy as Irganox® 1010) and the like. Other types of suitable antioxidants include diaryl amine antioxidants such as octylated diphenyl amine (Vanlube® 81), phenyl-α-naphthylamine, alkylphenyl-α-naphthylamine, or the reaction product of N-phenylbenzylamine with 2,4,4-trimethylpentene (Irganox® L-57 from Ciba Geigy), diphenylamine, ditoylamine, phenyl tolyamine, 4,4'-diaminodiphenylamine, di-p-methoxydiphenylamine, or 4-cyclohexylamino-diphenylamine. Still other suitable antioxidants include aminophenols such as N-butylaminophenol, N-methyl-N-amylaminophenol and N-isooctyl-p-aminophenol as well as mixtures of any such antioxidants.

A preferred mixture of antioxidants comprises 2,6-di-tert-butyl-p-cresol and di(octylphenyl)amine (e.g., a 1:1 mixture). Another preferred mixture of antioxidants is 2,6-di-tert-butyl-p-cresol, di(octylphenyl)amine and 6-methyl-2,4-bis[(octylthio)-methyl]-phenol (e.g., a 1:2:4 mixture). Still another preferred mixture of antioxidants is 2,6-di-tert-butyl-p-cresol, di(octylphenyl)amine and tetrakis[methylene (3,5-di-tert-butyl-4-hydroxyhydrocinnamate)]methane (e.g., a 1:2:3 mixture).

The antioxidant or mixture of antioxidants is employed in an amount effective to inhibit oxidation of the hydraulic fluid. Preferably, the antioxidant or mixture of antioxidants is employed in an amount ranging from about 0.5 to about 3 weight percent, more preferably from about 0.5 to 2.5 weight percent and still more preferably at from about 1 to 2 weight percent based on the total weight of the hydraulic fluid composition.

Phosphate ester-based hydraulic fluids and the hydrolysis products thereof are known to be corrosive to iron and iron alloys. Accordingly, in another preferred embodiment, the hydraulic fluid compositions of this invention further comprise a rust inhibitor or a mixture of rust inhibitors in an amount effective to reduce the formation of rust or corrosion on metal surfaces in contact or exposed to the hydraulic fluid. Suitable rust inhibitors are described, for example, in U.S. Pat. No. 5,035,084 and U.S. Pat. No. 4,206,067, the entire disclosures of which are incorporated herein by reference in their entirety.

Representative rust inhibitors include, by way of example, calcium dinonylnaphthalene sulfonate, a Group I or Group II metal overbased and/or sulfurized phenate, a compound of the formula:

$$R^4N[CH_2CH(R^5)OH]_2$$

wherein $R^4$ is selected from the group consisting of alkyl of from 1 to 40 carbon atoms, —$COOR^6$ and —$CH_2CH_2N$ $[CH_2CH(R^5)OH]_2$ where $R^6$ is alkyl of from 1 to 40 carbon atoms, and each $R^5$ is independently selected from the group consisting of hydrogen and methyl, including N,N,N',N'-tetrakis(2-hydroxypropyl) ethylene diamine and N,N-bis(2-hydroxyethyl)tallowamine (e.g., N tallow amine alkyl-2,2'-iminoobisethanol, sold under the tradename Ethomeen T/12); and mixtures thereof. In a preferred embodiment, $R^4$ is selected from the group consisting of alkyl having from 1 to 15 carbon atoms, and each $R^5$ is independently selected from the group consisting of hydrogen and methyl.

The Group I and Group II metal overbased and/or sulfurized phenates preferably are either sulfurized Group I or Group II metal phenates (without $CO_2$ added) having a Total Base Number (TBN) of from greater than 0 to about 200 or a Group I or Group II metal overbased sulfurized phenate having a TBN of from 75 to 400 prepared by the addition of carbon dioxide during the preparation of the phenate. More preferably, the metal phenate is a potassium or calcium phenate. Additionally, the phenate advantageously modifies the pH to provide enhanced hydrolytic stability.

Each of these components are either commercially available or can be prepared by art recognized methods. For example, Group II metal overbased sulfurized phenates are commercially available from Chevron Chemical Company, San Ramon, Calif. under the tradename OLOA® including, OLOA 219®, OLOA 216Q® and the like and are described by Campbell, U.S. Pat. No. 5,318,710, and by MacKinnon, U.S. Pat. No. 4,206,067. Likewise, N,N,N',N'-tetrakis(2-hydroxy-propyl)ethylenediamine is disclosed by MacKinnon, U.S. Pat. No. 4,324,674. The disclosures of each of these patents are incorporated herein by reference in their entirety.

Group I or II metal dinonylnaphthalene sulfonates, such as calcium dinonylnaphthalene sulfonate and Na-Sul 729 commercially available from King Industries, may also be used as a rust inhibitor in the hydraulic fluid composition in an amount ranging from 0.2 to 1.0 weight percent of the hydraulic fluid composition.

The rust inhibitor or mixture of rust inhibitors is employed in an amount effective to inhibit the formation of rust. Preferably, the rust inhibitor is employed in an amount ranging from about 0.001 to about 1 weight percent, more preferably about 0.005 to about 0.5 weight percent, and still more preferably at about 0.01 to 0.1 weight percent based on the total weight of the hydraulic fluid composition. In a preferred embodiment, the rust inhibitor comprises a mixture of N,N,N',N'-tetrakis(2-hydroxypropyl) ethylenediamine and a Group II metal overbased phenate (e.g., a 5:1 mixture). In another preferred embodiment, the rust inhibitor comprises a mixture of N,N-bis(2-hydroxyethyl)tallowamine (Ethomeen® T/12) and a Group II metal overbased phenate (e.g., a 5:1 mixture).

The hydraulic fluid compositions of this invention can optionally contain further additives such as copper corrosion inhibitors, anti-foaming agents, dyes, etc. Such additives are well-known in the art and are commercially available.

Utility

The phosphate ester base fluids of this invention are useful for preparing aircraft hydraulic fluids and the like. The aircraft hydraulic fluid compositions described herein are useful in aircraft hydraulic systems where they operate as a power transmission medium. The use of mixed n-butyl/isobutyl phosphate esters in the base stock has been found to provide for an unexpected, surprising balance of properties critical to aviation hydraulic oils, including acceptable hydrolytic stability, high flash point, good anti-wear properties, acceptable erosion protection, acceptable low temperature flow properties (viscosity), and elastomer compatibility.

The following examples are offered to illustrate this invention and are not to be construed in any way as limiting the scope of this invention.

EXAMPLES

Example 1

Preparation of Di-n-Butyl Chlorophosphate

Dry n-butanol (127.4 g, 1.72 moles) in about 200 mL of dry benzene was cooled to 0° C. Phosphorus trichloride (78.7 g, 0.57 mole) in 50 mL of benzene was added slowly to the reaction mixture at 0° C. over a 1 hour period with stirring. Vapor evolution was observed. After the addition of the phosphorus trichloride, sulfuryl chloride (76.9 g, 0.57 mole) in 45 mL of benzene was added to the reaction mixture at 0° C. over a 1 hour period with stirring. The reaction mixture was then stirred for 2 hours at room temperature during which time copious amounts of HCl gas were evolved. Gases and solvent were removed using a Roto-vap. The resulting colorless to very pale yellow viscous liquid (130 g) was used immediately in Example 2.

Example 2

Preparation of Di-n-Butyl Isobutyl Phosphate

A solution of di-n-butyl chlorophosphate (130.3 g, 0.57 mole) in 600 mL of dichloromethane containing 55.37 g (0.70 mole) of pyridine was cooled to 0° C. Isobutanol (42.25 g, 0.57 mole) was added dropwise over 1 hour. The formation of a white precipitate was immediately observed. The reaction mixture was then stirred for 24 hours at room temperature. The pyridinium hydrochloride was filtered off, and the solution was washed with water (2×250 mL), aqueous 0.5 N HCl (2×250 mL) and water (25×250 mL). The organic phase was dried over anhydrous magnesium sulfate for 12 hours. Filtration of the drying agent, followed by the removal of the solvent using a Roto-vap, yielded di-n-butyl isobutyl phosphate as a clear colorless liquid. Distillation of the crude product (68° C. at 0.02 torr) gave 125 g of 94.8% di-n-butyl isobutyl phosphate (DBIBP).

Example 3

Preparation of Diisobutyl Chlorophosphate

Dry isobutanol (127.4 g, 1.72 moles) in about 200 mL of dry benzene was cooled to 0° C. Phosphorus trichloride (78.7 g, 0.57 mole) in 50 mL of benzene was added slowly to the reaction mixture over a 1 hour period at 0° C. Vapor evolution was observed. After the addition of the phosphorus trichloride, sulfuryl chloride (76.9 g, 0.57 mole) in 45 mL of benzene was added at 0° C. over a 1 hour period with stirring. The reaction mixture was then stirred for 2 hours at room temperature during which time copious amount of HCl gas were evolved. Gases and solvent were removed using a Roto-vap. The resulting colorless to very pale yellow viscous liquid (130 g) was used immediately in Example 4.

Example 4

Preparation of n-Butyl Diisobutyl Phosphate

A solution of diisobutyl chlorophosphate (130.3 g, 0.57 mole) in 600 mL of dichloromethane and 55.37 g (0.70 mole) of pyridine was cooled to 0° C. n-Butanol (42.25 g, 0.57 mole) was added dropwise over 1 hour. The formation of a white precipitate was immediately observed. The reaction mixture was then stirred for 24 hours at room temperature. The pyridinium hydrochloride was filtered off and the solution washed with water (2×250 mL), aqueous 0.5 N HCl (2×250 mL) and water (2×250 mL). The organic phase was dried over anhydrous magnesium sulfate for 12 hours. Filtration of the drying agent, followed by the removal of the solvent using a Roto-vap, yielded n-butyl diisobutyl phosphate as a clear colorless liquid. Distillation of the crude product (68° C. at 0.02 torr) gave 125 g of 96% n-butyl diisobutyl phosphate (BDIBP).

Example 5

GC Analysis of Mixed Phosphate Esters

The products of Examples 2 and 4 were analyzed using conventional gas chromatography. The results are shown Table I:

TABLE I

| Component | Example 2 Wt. % | Example 4 Wt. % |
|---|---|---|
| Tri-n-butyl phosphate (TBP) | 0.6 | 0.3 |
| Di-n-butyl isobutyl phosphate (DBIBP) | 94.8 | 2.7 |
| n-Butyl diisobutyl phosphate (BDIBP) | 3.6 | 96.0 |
| Triisobutyl phosphate (TIBP) | 1.0 | 1.0 |

Table I shows that the products of Examples 2 and 4 contain 0.6 weight percent or less of tri-n-butyl phosphate and 1.0 weight percent of triisobutyl phosphate.

Example 6

Comparison of the Density and Viscosity of Phosphate Esters

In this example, the density and the viscosity properties of the product from Example 2, i.e., essentially di-n-butyl isobutyl phosphate (DBIBP) containing approximately 66.6% n-butyl groups and 33.3% isobutyl groups, is compared to a physical mixture containing 66.6 wt. % tri-n-butyl phosphate (TBP) and 33.3 wt. % triisobutyl phosphate (TIBP). Similarly, the density and the viscosity properties of the product from Example 4, i.e., essentially n-butyl diisobutyl phosphate (BDIBP) containing approximately 33.3% n-butyl groups and 66.6% isobutyl groups, is compared to a physical mixture containing 33.3 wt. % tri-n-butyl phosphate and 66.6 wt. % triisobutyl phosphate. Additionally, both products are compared to tri-n-butyl phosphate and triisobutyl phosphate. The results are shown in Table II:

TABLE II

| | Density | Viscosity (cSt) | |
|---|---|---|---|
| Composition | 25° C. | −54° C. | 40° C. |
| Example 2 - DBIBP | 0.9730 | 137 | 2.49 |
| 66.6 wt. % TBP/ 33.3 wt. % TIBP | 0.9686 | 175 | 2.69 |
| Example 4 - BDIBP | 0.9692 | 223 | 2.70 |
| 33.3 wt. % TBP/ 66.6 wt. % TIBP | 0.9645 | 264 | 2.81 |
| 100 wt. % TIBP | 0.9604 | 456 | 3.00 |
| 100 wt. % TBP | 0.9725 | 124 | 2.55 |

Unexpectedly, the results in Table II show that the viscosity at −54° C. and at 40° C. of the Example 2 product, which is essentially all DBIBP, is lower than the physical mixture of 66.6% TBP/33.3% TIBP. Similarly, the viscosity at −54° C. and at 40° C. of the Example 4 product, which is essentially all BDIBP, is lower than the physical mixture of 33.3% TBP/66.6% TIBP. In particular, low viscosity at −54° C. is desirable in an aircraft hydraulic system during low temperature operation.

FIG. 1 illustrates that a physical mixture of about 45 wt. % tri-n-butyl phosphate (TBP) and 55 wt % triisobutyl phosphate (TIBP) would be required to obtain a composition having viscometric properties similar to those of the product of Example 4. Similarly, a physical mixture of about 94 wt % TBP and 6 wt % TIBP would be required to obtain a composition having viscometric properties similar to those of the product of Example 2.

Example 7

Comparison of the Density and Viscosity of Blends

In this example, the density and viscosity of phosphate ester base stock compositions (from Example 6) were compared after adding 0.5 wt. % of a 2.6-di-tert-butyl-4-methyl phenol antioxidant, 0.5 wt. % of an amine antioxidant such as Vanlube 81, 6 wt. % of an acid scavenger, 8 wt. % of a triaryl phosphate such as Reolube 140 (from FMC), and 14 wt. % of a VI improver (approximately 6.5 weight percent polymer and the remainder TBP as solvent). The results are shown in Table III:

TABLE III

| Base Stock | Density | Viscosity (cSt) | | |
|---|---|---|---|---|
| Composition | 25° C. | −54° C. | 40° C. | 100° C. |
| Example 2 - DBIBP | 0.9866 | 1356 | 9.36 | 3.32 |
| 66.6 wt. % TBP/ 33.3 wt. % TIBP | 0.9832 | 1439 | 9.60 | 3.34 |
| Example 4 - BDIBP | 0.9843 | 2588 | 10.40 | 3.50 |
| 33.3 wt. % TBP/ 66.6 wt. % TIBP | 0.9803 | 2205 | 10.17 | 3.43 |
| 100 wt. % TIBP | 0.9775 | 3737 | 10.83 | 3.51 |
| 100 wt. % TBP | 0.9859 | 1013 | 9.12 | 3.28 |

Aircraft hydraulic fluids are required by some aircraft manufacturer specifications to have a viscosity at −54° C. of 2000 cSt or less. The data in Table III demonstrates that compositions formulated using the product of Example 2 (essentially DBIBP) are particularly useful for meeting this requirement. Additionally, such compositions are essentially free of the skin irritant TBP.

Example 8

Representative Base Stock Formulations

This example illustrates several different formulations for the base stock compositions of this invention. It is understood, of course, that these compositions can vary widely within the scope of this invention and that these base stock formulations are only illustrative in nature. In this example, base stock components I, II and III refer to the following:

I

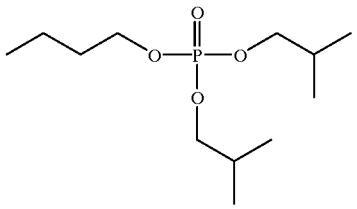

II

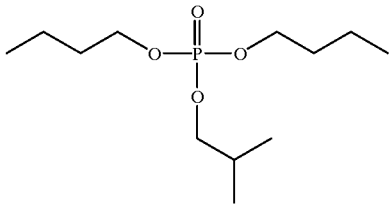

-continued

III

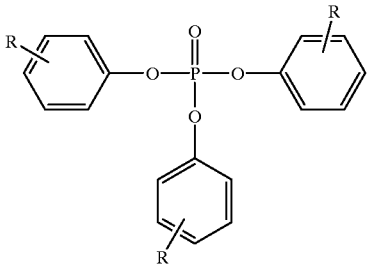

wherein each R is independently an alkyl group.

Specifically, the base stock formulations shown in Table IV can be prepared.

TABLE IV

| | Component I | Component II | Component III |
|---|---|---|---|
| Ex. 8A | 85–100% | — | 0–15% |
| Ex. 8B | — | 85–100% | 0–15% |
| Ex. 8C | Component I/II = 85–100% with Component I = 1 to 84% and Component II = 1 to 84% | | 0–15% |

In these formulations, all reported percents are percents by weight based on the total weight of the base stock.

Example 9

Representative Formulations of the Invention

The Examples shown in Table V are examples of formulations of this invention. In these examples, all percents are percents by weight based on the total weight of the composition. Formulation Examples 9A–9E can be prepared by blending the following components:

TABLE V

| Component | Ex. 9A | Ex. 9B | Ex. 9C | Ex. 9D | Ex. 9E | Ex. 9F |
|---|---|---|---|---|---|---|
| n-Butyl diisobutyl phosphate | 37.5% | 82% | — | 40% | 30% | 5% |
| Di-n-butyl isobutyl phosphate | 37.5% | — | 78% | 48% | 30% | 55% |
| Triaryl phosphate | 12.5% | 6% | 10% | — | 7% | 7% |
| VI Improver | 5.1% | 4.8% | 5.0% | 4.7% | 5% | 5% |
| Acid Control Additive | 5.8% | 5.6% | 5.6% | 5.7% | 6.5% | 6.5% |
| Erosion Inhibitor | 0.07% | 0.05% | 0.06% | 0.07% | 0.06% | 0.06% |
| Rust Inhibitor | 0.06% | 0.06% | 0.09% | 0.06% | 0.1% | 0.1% |
| Antioxidant | 1.5% | 1.5% | 1.3% | 1.5% | 1.35% | 1.35% |
| Dyes | 0.0014% | 0.0014% | 0.0014% | 0.0014% | 0.0014% | 0.0014% |
| Antifoaming Agents | 0.001% | 0.001% | 0.001% | 0.001% | 0.001% | 0.001% |
| Tri-n-butyl phosphate | — | — | — | — | 10% | — |
| Triisobutyl phosphate | — | — | — | — | 10% | 20% |

What is claimed is:

1. An aircraft hydraulic fluid composition comprising:

(a) from about 30 to about 95 weight percent, based on the total weight of the fluid, of a phosphate ester selected from the group consisting of n-butyl diisobutyl phosphate, di-n-butyl isobutyl phosphate and mixtures thereof;

(b) from 0 to about 15 weight percent, based on the total weight of the fluid, of one or more triaryl phosphates;

(c) an effective amount of a viscosity index improver;

(d) an effective amount of acid control additive; and (e) an effective amount of an erosion inhibitor.

2. The aircraft hydraulic fluids of claim 1, wherein the aircraft hydraulic fluid further comprises:

(f) an effective amount of a rust inhibitor or a mixture of rust inhibitors; and (g) an effective amount of an antioxidant or a mixture of antioxidants.

3. The aircraft hydraulic fluid of claim 1, wherein the phosphate ester is n-butyl diisobutyl phosphate.

4. The aircraft hydraulic fluid of claim 1, wherein the phosphate ester is di-n-butyl isobutyl phosphate.

5. An aircraft hydraulic fluid composition comprising about 30 to about 95 weight percent, based on the total weight of the fluid, of a phosphate ester base stock comprising a phosphate ester selected from the group consisting of n-butyl diisobutyl phosphate, di-n-butyl isobutyl phosphate and mixtures thereof, and a sufficient amount of one or more triaryl phosphates such that the base stock composition produces no more than 25% elastomer seal swell; an effective amount of a viscosity index improver; an effective amount of acid control additive; and an effective amount of an erosion inhibitor.

6. An aircraft hydraulic fluid composition comprising about 30 to about 95 weight percent, based on the total weight of the fluid, of a phosphate ester base stock comprising from about 4 to about 14 weight percent, based on the total weight of the fluid, of one or more triaryl phosphates, the remainder of the base stock comprising a phosphate ester selected from the group consisting of n-butyl diisobutyl phosphate, di-n-butyl isobutyl phosphate and mixtures thereof; an effective amount of a viscosity index improver; an effective amount of acid control additive; and an effective amount of an erosion inhibitor.

7. An aircraft hydraulic fluid comprising:

(a) from about 30 to about 95 weight percent, based on the total weight of the fluid, of a phosphate ester selected from the group consisting of n-butyl diisobutyl phosphate, di-n-butyl isobutyl phosphate and mixtures thereof;

(b) from about 0 to about 15 weight percent, based on the total weight of the fluid, of one or more triaryl phosphates;

(c) from about 4 to 6 weight percent, based on the total weight of the fluid, of a viscosity index improver;

(d) from about 5 to 6.5 weight percent, based on the total weight of the fluid, of an acid control additive;

(e) from about 0.05 to about 0.1 weight percent, based on the total weight of the fluid, of an erosion inhibitor;

(f) from about 0.005 to about 0.5 weight percent, based on the total weight of the fluid, of a rust inhibitor or a mixture of rust inhibitors; and (g) from about 0.5 to about 2.5 weight percent, based on the total weight of the fluid, of an antioxidant or a mixture of antioxidants.

8. The aircraft hydraulic fluid of claim 7, wherein the phosphate ester is n-butyl diisobutyl phosphate.

9. The aircraft hydraulic fluid of claim 7, wherein the phosphate ester is di-n-butyl isobutyl phosphate.

10. The aircraft hydraulic fluid of claim 7, wherein the phosphate ester is a mixture of n-butyl diisobutyl phosphate and di-n-butyl isobutyl phosphate.

11. The aircraft hydraulic fluid of claim 7, wherein the aircraft hydraulic fluid further comprises from about 1 to about 30 weight percent of triisobutyl phosphate based on the total weight of the fluid.

12. The aircraft hydraulic fluid of claim 7, wherein the aircraft hydraulic fluid comprises less than 15 weight percent of tri-n-butyl phosphate based on the total weight of the fluid.

13. The aircraft hydraulic fluid of claim 7, wherein the aircraft hydraulic fluid comprises less than 5 weight percent of tri-n-butyl phosphate based on the total weight of the fluid.

* * * * *

UNITED STATES PATENT AND TRADEMARK OFFICE

CERTIFICATE OF CORRECTION

PATENT NO. : 6,254,799 B1
DATED : July 3, 2001
INVENTOR(S) : Antika, Shlomo, Piorier and Marc-Andre It is certified that error appears in the above-identified patent and that said Letters Patent is hereby corrected as shown below:

Title page,
Item [75] Inventor's name appears as "Marc-Andre Poirer". This should be changed to -- Poirier --.

Signed and Sealed this

Twenty-first Day of May, 2002

*Attest:*

*Attesting Officer*

JAMES E. ROGAN
*Director of the United States Patent and Trademark Office*